US007284756B2

(12) United States Patent
Pierce et al.

(10) Patent No.: US 7,284,756 B2
(45) Date of Patent: Oct. 23, 2007

(54) METHOD FOR OPERATING MECHANICAL CASINO BONUS GAME IN THE PRESENCE OF MECHANICAL BIAS

(75) Inventors: Jesse E. Pierce, Las Vegas, NV (US); Olaf Vancura, Somerville, MA (US)

(73) Assignee: Progressive Gaming International Corporation, Las Vegas, NV (US)

( * ) Notice: Subject to any disclaimer, the term of this patent is extended or adjusted under 35 U.S.C. 154(b) by 133 days.

(21) Appl. No.: 11/135,046

(22) Filed: May 23, 2005

(65) Prior Publication Data

US 2005/0215305 A1 Sep. 29, 2005

Related U.S. Application Data

(63) Continuation of application No. 10/161,568, filed on Jun. 3, 2002, now Pat. No. 6,896,261, which is a continuation of application No. 09/632,357, filed on Aug. 3, 2000, now Pat. No. 6,398,219, which is a continuation of application No. 09/442,831, filed on Nov. 17, 1999, now Pat. No. 6,139,013, which is a continuation of application No. 09/098,804, filed on Jun. 17, 1998, now Pat. No. 6,047,963.

(60) Provisional application No. 60/081,724, filed on Apr. 14, 1998.

(51) Int. Cl.
*A63F 3/00* (2006.01)

(52) U.S. Cl. ..... 273/121 B; 273/126 A

(58) Field of Classification Search ..... 463/16–20, 463/25–31, 9; 273/121 B, 126 A, 108, 118 A–118 R, 273/119 A–119 R, 129 R–129 W
See application file for complete search history.

(56) References Cited

U.S. PATENT DOCUMENTS

| | | | |
|---|---|---|---|
| 426,546 | A | 4/1890 | Reed |
| 524,475 | A | 8/1894 | Wheeland |
| 1,181,027 | A | 4/1916 | Mannhardt |
| 1,520,345 | A | 12/1924 | Hamilton |
| 1,947,772 | A | 2/1934 | Harris |
| 2,032,677 | A | 3/1936 | Watson |
| 2,192,622 | A | 3/1940 | Radtke |

(Continued)

FOREIGN PATENT DOCUMENTS

DE 2 359 603 6/1974

(Continued)

OTHER PUBLICATIONS

Marshall Fey, Slot Machines, 1983, pp. 126 and 150, Reno, Nevada.

(Continued)

*Primary Examiner*—Robert E Pezzuto
(74) *Attorney, Agent, or Firm*—Dorr, Carson & Birney, P.C.

(57) ABSTRACT

A method for operating a mechanical casino bonus game to provide a constant player expected value for play of a mechanical casino bonus game in the presence of mechanical bias. When play of the bonus game commences, a bonus payoff is randomly assigned from a set of bonus payoffs to each game outcome.

15 Claims, 7 Drawing Sheets

U.S. PATENT DOCUMENTS 2,614,840 A 10/1952 Monkres
2,732,210 A 1/1956 Heide
3,383,111 A 5/1968 Lucas
3,405,459 A 10/1968 Belokin, Jr.
3,531,114 A 9/1970 Parks et al.
3,797,828 A 3/1974 Ishikawa et al.
3,807,736 A 4/1974 Goldfarb et al.
3,825,265 A 7/1974 Pitkanen et al.
3,897,951 A 8/1975 Morrison et al.
3,956,527 A 5/1976 Magdo et al.
4,055,342 A 10/1977 Matsumoto
4,055,344 A 10/1977 Soucie
4,072,930 A 2/1978 Lucero et al.
4,108,361 A 8/1978 Krause
4,283,709 A 8/1981 Lucero et al.
4,508,336 A 4/1985 Yokoi
4,531,187 A 7/1985 Uhland
4,772,931 A 9/1988 Rogers
4,840,375 A 6/1989 Lawlor et al.
4,871,171 A 10/1989 Rivero
5,004,238 A 4/1991 Okada
5,016,879 A * 5/1991 Parker et al. ..... 273/126 A
5,120,060 A 6/1992 Parker et al.
5,130,268 A 7/1992 Liou et al.
5,131,655 A 7/1992 Ugawa
5,149,095 A 9/1992 Kashimoto et al.
5,241,379 A 8/1993 Tsujita
5,342,049 A 8/1994 Wichinsky et al.
5,360,214 A 11/1994 Harmen
5,393,057 A 2/1995 Marnell, II
5,462,277 A 10/1995 Takemoto
5,494,287 A 2/1996 Manz
5,496,032 A 3/1996 Okada
5,509,654 A 4/1996 Takemoto et al.
5,509,655 A * 4/1996 Ugawa ..... 273/121 B
5,516,104 A 5/1996 Takemoto et al.
5,542,669 A 8/1996 Charron et al.
5,603,659 A 2/1997 Okada
5,628,685 A 5/1997 Takemoto et al.
5,636,837 A 6/1997 Takemoto et al.
5,639,089 A 6/1997 Matsumoto et al.
5,664,775 A 9/1997 Kao
5,707,285 A 1/1998 Place et al.
5,743,523 A 4/1998 Kelly et al.
5,785,594 A 7/1998 Seibert, Jr. et al.
5,788,230 A 8/1998 Krise et al.
5,836,819 A * 11/1998 Ugawa ..... 463/30
5,845,902 A 12/1998 Takemoto
5,846,902 A 12/1998 Boyles et al.
5,882,261 A 3/1999 Adams
5,971,851 A 10/1999 Pascal et al.
6,047,963 A 4/2000 Pierce et al.
6,139,013 A 10/2000 Pierce et al.
6,220,593 B1 4/2001 Pierce et al.
6,244,595 B1 6/2001 Kelly et al.
6,311,976 B1 11/2001 Yoseloff et al.
6,338,678 B1 1/2002 Seelig et al.
6,340,158 B2 1/2002 Pierce et al.
6,364,767 B1 4/2002 Brossard et al.
6,398,219 B1 6/2002 Pierce et al.
6,446,964 B1 9/2002 Kelly et al.
6,491,296 B2 12/2002 Kelly et al.
6,533,273 B2 3/2003 Cole et al.
6,582,307 B2 6/2003 Webb
6,608,362 B1 8/2003 Kai et al.
6,645,073 B2 11/2003 Lemay et al.
6,695,699 B2 2/2004 Beaulieu
2002/0017756 A1 2/2002 Kelly et al.
2002/0037765 A1 3/2002 Johnson
2003/0015838 A1 1/2003 Kelly et al.
2004/0155399 A1 8/2004 Inoue

FOREIGN PATENT DOCUMENTS

DE 32 20 395 A1 12/1983
DE 40 14 477 A1 7/1991
EP 0 189 256 A2 7/1986
EP 0 671 713 A1 9/1995
GB 2 201 821 A 9/1988
GB 2 218 558 A 11/1989
JP 3-68382 3/1991
JP 4-73076 3/1992
JP 2002-325955 A 11/2002

OTHER PUBLICATIONS

Richard M. Bueschel, An Illustrated Price Guide to the 100 Most Collectible Trade Stimulators, 1978, pp. 21, 29 and 83, U.S.A.

* cited by examiner 220
30
10
210
230
40B
40A
22
240
24
270
40C
26
20
28

METHOD FOR OPERATING MECHANICAL CASINO BONUS GAME IN THE PRESENCE OF MECHANICAL BIAS

RELATED INVENTION

This application is a continuation of U.S. patent application Ser. No. 10/161,568 filed Jun. 3, 2002 now U.S. Pat. No. 6,896,261, which is a continuation of U.S. patent application Ser. No. 09/632,357 filed Aug. 3, 2000, now U.S. Pat. No. 6,398,219 issued Jun. 4, 2002, which is a continuation of U.S. patent application Ser. No. 09/442,831 filed Nov. 17, 1999, now U.S. Pat. No. 6,139,013 issued Oct. 31, 2000, which is a continuation of U.S. patent application Ser. No. 09/098,804 filed Jun. 17, 1998, now U.S. Pat. No. 6,047,963 issued Apr. 11, 2000, which claims priority to U.S. Provisional Patent Application Ser. No. 60/081,724 filed Apr. 14, 1998 entitled "PACHINKO STAND-ALONE AND BONUSING GAME."

BACKGROUND OF THE INVENTION

1. Field of the Invention

The present invention relates to Pachinko games and, in particular, to a Pachinko stand-alone game and to a Pachinko bonus game for an underlying game such as a slot machine.

2. Statement of the Problem

Slot machine bonusing features have become popular, and examples of their success include WHEEL OF GOLD, WHEEL OF FORTUNE, JEOPARDY!, REEL 'EM IN, PIGGY BANKIN', and many others. What has been heretofore lacking is a bonus game which utilizes the excitement and dynamic qualities of Pachinko. A need exists to provide a form of Pachinko as a bonus game for an underlying game such as a slot machine.

One problem associated with Pachinko games, in general, is that wear and tear caused by repeated play causes bias to occur wherein a ball may more frequently pass through certain lanes rather than through other lanes. A need exists to provide random payoffs during the play of Pachinko whether as a bonus game for an underlying game or as a stand-alone game despite bias caused by wear and tear.

U.S. Pat. No. 5,016,879 provides a Pachinko game wherein one of a fixed set of scoring value symbols (i.e., the $100, plum and cherry symbols as shown in FIG. 4) associated with each scoring slot is selectively illuminated for the entire game. A random number generator has a plurality of numbers which are assigned to each of the value symbols so that at the insertion of a bet, the random number generator identifies which of the three possible value symbols will be active in each scoring slot for that particular game. While this solves the above-stated need to overcome bias, it limits payoff to a fixed or static number of value symbols provided at each slot. Once a set of values are allocated, the random selection merely reassigns the allocated values to new scoring slots in the next game. In order to provide a higher payoff, the '879 patent provides a "free" game. If during the "free" game the player hits a back-to-back jackpot, then a large payoff is made. For example, when the player receives three "100s," the player receives a "free" game. In the "free" game, if the player again receives three "100s," the player wins the large payoff. A need exists to provide a Pachinko game that does not provide a static number of payoff value symbols for each slot and also provides a full range of higher payoff awards without the requirement of a "free" game. A need also exists to provide displayed payoff values at each lane that change during the play of the game.

Finally, a need also exists to provide additional excitement to the conventional play of a game such as video poker, slot machines and the like by providing additional random play in the dispensing of different values when a winning combination on the game is obtained.

SUMMARY OF THE INVENTION

1. Solution to the Problem. The present invention addresses the aforesaid needs. The Pachinko bonus game of the present invention is placed near an existing slot machine such as on top of, at the rear of, side-by-side with, or located near (such as on a wall). The Pachinko bonus game is started when an initiation condition such as when a symbol or combination of symbols align on the payline of the slot machine. The payoff selection and display on a per game basis is random so that biasing caused by wear and tear is eliminated whether the Pachinko game is played as a bonus game or as a stand-alone game. The Pachinko game can be used to dispense large payoffs periodically as well as smaller payoffs for conventional winning combinations of the underlying game. Finally, the payoff values displayed at the Pachinko game can vary during the play of the game.

2. Summary. The present invention pertains to a Pachinko bonus game system for an underlying game machine (such as a slot machine) being played by a player. The underlying game machine has a credit meter. The Pachinko bonus game system provides a playing field wherein the playing field has a plurality of rows of pegs with each row of pegs staggered from each adjacent row. A ball is launched onto the playing field by a launch mechanism. The launching or propelling of the ball onto the playing field occurs when an initiate condition occurs during play of the underlying game. In the case of a slot machine, the initiate condition can be the appearance of a special symbol on the payline. A number of different initiate conditions can be utilized based upon the underlying game. A row of lanes are provided on the playing field. The ball, after traversing among the pegs on the playing field, eventually travels through one of the lanes. At each lane is displayed a bonus payoff value. The lane the ball travels through senses the presence of the ball and the value displayed for that lane is added to the credit meter. The bonus payoff values are displayed at each lane with a flush mounted display so as not to interfere with or impede the travel of the ball through the lane. The bonus payoff values are randomly changed which would eliminate any mechanical bias present in the Pachinko game. The payoff values can also change during play of the game.

The Pachinko stand-alone game operates independently of an underlying game and is conventionally activated by a player to play the game. However, the playing field, ball, launch mechanism, rows of lanes, and the payoff display are as described above for the Pachinko bonus game with the exception of the credit meters in the Pachinko stand-alone game.

And in yet another embodiment of the present invention, the Pachinko game system operates as a payoff dispenser for a conventional game.

DETAILED DESCRIPTION OF THE INVENTION

Figure 1:
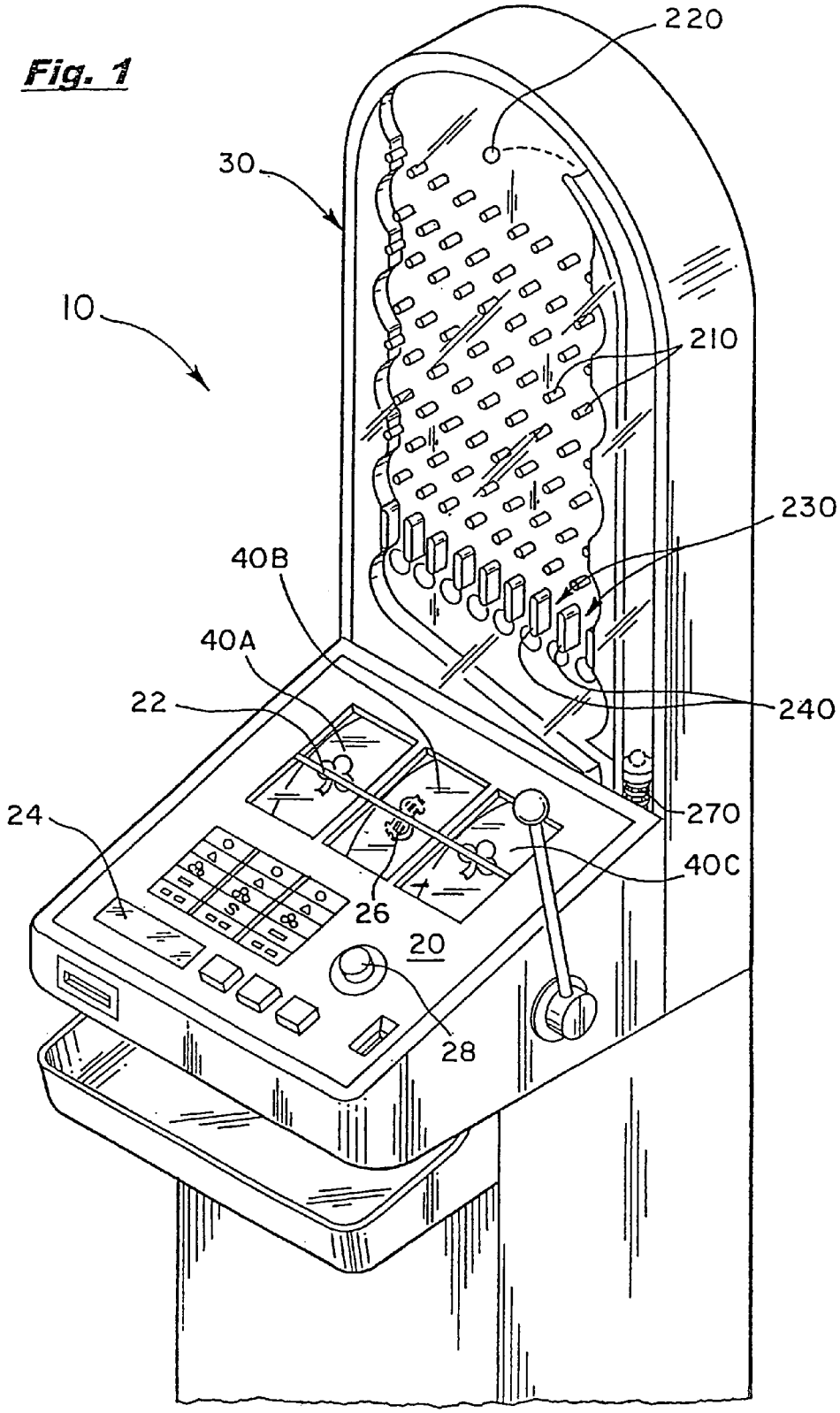
FIG. 1 illustrates the Pachinko bonus game of the present invention associated with a slot machine.

1. Overview. In FIG. 1, the system 10 of the present invention is shown to include an underlying game such as a conventional slot machine 20 modified according to the teachings herein and a Pachinko bonus game 30 also modified according to the teachings herein. In FIG. 1, which represents one embodiment of the present invention, the Pachinko bonus game 30 is vertically mounted at the rear of a slanted slot machine 20. The Pachinko bonus game is located at the slot machine 20. The term "at" includes locating the Pachinko bonus game 30 "at the rear of," "on top of," "side-by-side with" or "near" the underlying game 20. Furthermore, one Pachinko bonus game 30 could be used with a number of underlying games 20 such as twenty slot machines. In which case, the Pachinko bonus game would be mounted at a central location such as on a wall above the slot machines. Furthermore, the underlying game 20 can be any suitable game such as, but not limited to: slot machines, video poker, and other automated gaming machines, live-table games, and other games of chance. In the following the configuration of FIG. 1 is used to illustrate the teachings of the present invention. For example, the Pachinko bonus game could be located near the slot machine 20, such as mounted on a wall and connected thereto by a cable.

The adjacent slot machine 20 functions conventionally when taking wagers, making payments and being played. The slot machine 20 has a conventional credit meter 24 which displays the player's current credits. Slot machines 20 are conventional and are made by a number of different manufacturers. How and in what form (i.e., coin-ins, dollar acceptors, magnetic cards, smart cards, etc.) wagers are placed at the slot machine 20 by a player is immaterial to the teachings of the present invention. What is material is that the credit meter 24 of the slot machine 20 is modified to increase when the player wins at the Pachinko bonus game 30. In addition, should an initiation condition arise during play of the slot machines such as a special symbol 26 (or set of symbols) appearing on the payline 22 of the slot machine 20, it automatically activates the Pachinko bonus game 30 (and deactivates the slot machine 20) so that the player of the slot machine 20 can play the Pachinko bonus game 30. Other means to "initiate" the Pachinko bonus game 30 are possible. The occurrence of a "winning combination" in the underlying game such as "two cherries" in a slot machine, or "twenty-one" in a blackjack game, or "three twos" in joker poker. The occurrence of the player accumulating a predetermined amount of winning such as "seventy-seven" dollars (or coins) in the underlying game. The occurrence of a symbol such as a "bonus" symbol appearing anywhere in the window or field of view in a slot machine even if it is not on the payline or receiving a card in a card game having a bonus symbol on it. The occurrence of an event such as a random signal to participate in the bonus game.

When utilized as a bonusing mechanism, the preferred Pachinko bonus game 30 embodiment utilizes one ball 220, which is propelled up onto a playing field 200 comprising alternately spaced rows of pegs 210. After traversing the playing field 200, the ball 220 falls through one of a plurality of chutes or lanes 230 separated by bumpers 240. The player receives an appropriate bonus payoff corresponding to the lane 230 the ball 220 travels through. The bonus payoff is credited to the slot game meter 24. The bonus game 30 ends and play reverts to the slot machine 20. The Pachinko game could also have a separate credit meter which is selectively incremented.

The underlying game could be any suitable game such as, but not limited to, a live game such as cards, roulette, etc. or a gaming machine such as slots, joker poker, Pachinko, etc. While the present invention uses a single ball, it is to be understood that more than one ball can be launched or that more than one launch could occur during play of the game.

Figure 2:
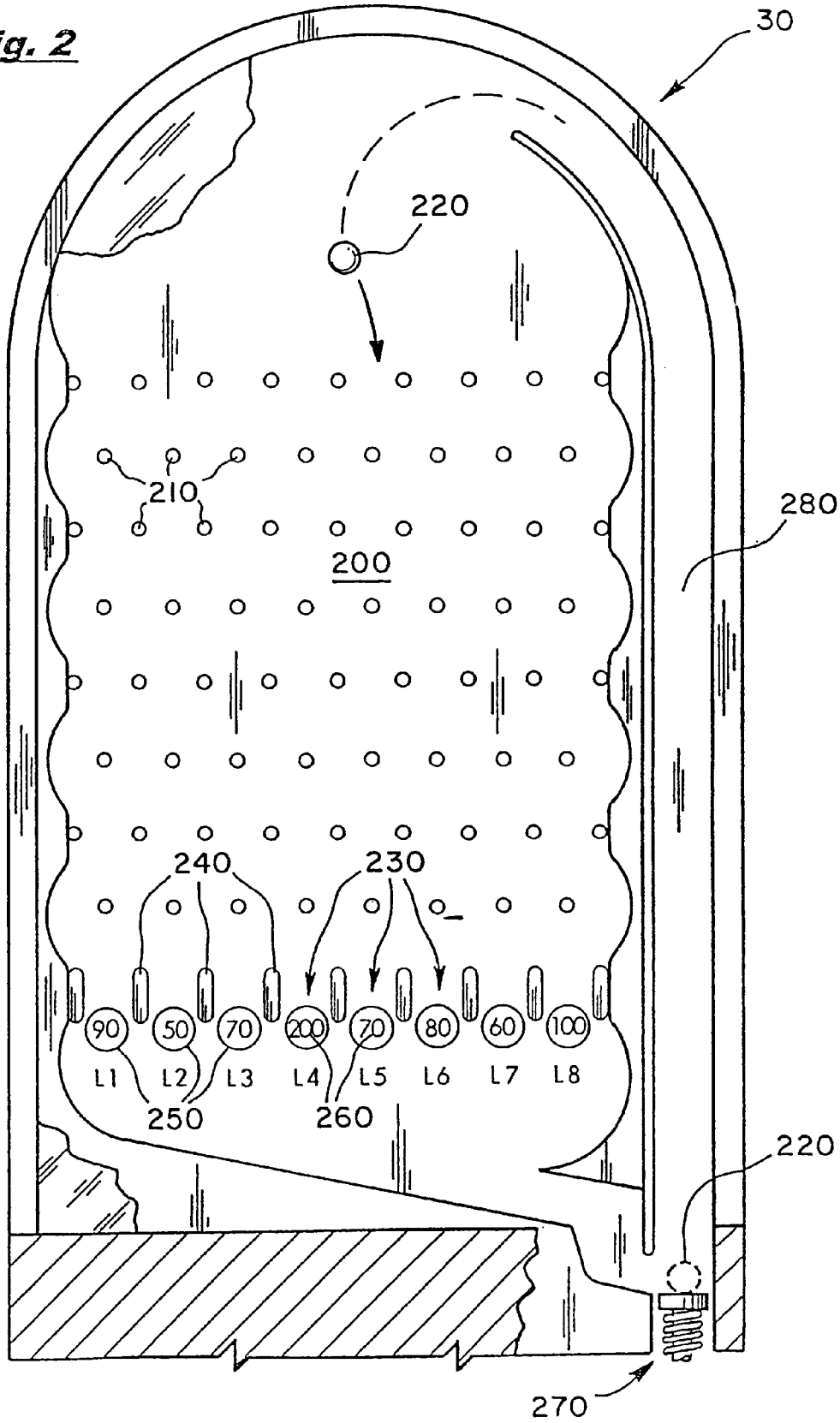
FIG. 2 is a front view of the Pachinko bonus game of the present invention.

2. Details of Pachinko Game 30. In FIG. 2, the Pachinko bonus game 30, in the preferred embodiment, has eight payable lanes 230: L1-L8. Any suitable number of lanes 230 could be used such as but not limited to 6, 10, 13, etc. The displays 250 shows the payoffs in each of the eight lanes to the player. Each payoff display 250 is a digital meter which is flush mounted in the field 200 so as not to interfere with the ball 220. The displays 250, in some embodiments, may be located in a separate viewing area on, the Pachinko bonus game 30 although it is preferred to have the displays 250 located at (i.e., in, above, or near) the lanes 230 so that a player may easily view the bonus payoff for that lane. The display 250 is a conventional digital display such as an LED and it may be circular, square, or any suitable shape or design. It is to be expressly understood that in certain embodiments of the present invention, the display 250 can be simply printed with fixed bonus payout values. As will be explained in the following, in the preferred embodiment the displays 250 are utilized to display individual payout values 260 for each lane 230. Furthermore, the actual design of the field 200 for the Pachinko bonus game 30, as is conventionally done, varies considerably from manufacturer to manufacturer. While the playing field uses pegs, any suitable deflection device such as pins, bumpers, flippers, etc. could be utilized. Hence, the present invention is not meant to be limited by the design characteristics of the Pachinko game 30.

In the preferred embodiment, the Pachinko game 30 of FIG. 2 becomes activated when an initiation condition occurs in the underlying game 20. For example, in FIG. 1, the appearance of a dollar sign 26 anywhere on the payline 22 allows the player to play the Pachinko bonus game 30. Any symbol or combination of symbols may be used to activate the Pachinko bonus game 30 such as, but not limited to, a graphic Pachinko symbol, a four-leaf clover, or the word "bonus." When the Pachinko game is activated, a light and sound campaign can be used to signal to people in the vicinity of the player's opportunity to play the Pachinko bonus game 30. For live games such as cards, the dealer or player can activate the game. The player pushes button 28 to activate the firing mechanism 270 which launches the ball 220 forcefully upward from the bottom and along the side of the machine as shown in area 280 and onto the playing field 200. In another design, the ball launch is automatic and occurs automatically after the initiation condition occurs. Assume in FIG. 2, that the ball 200 is directed through lane L6 in which case the player receives the payoff 260 displayed in display 250 of $80 (or 80 coins). The credit meter 24 of the slot machine 20 is then incremented by the value of the payoff. The payoff could also be made in coupons, tickets, free plays, etc. In which case, the credit meter 24 would not be incremented. It is to be understood that a separate credit meter, not shown in FIG. 4, but shown in FIG. 6, could be utilized to keep track of the bonus payoffs.

The ball 220 is preferably three-quarters of an inch to one and one-half inch in diameter (i.e. about one inch). For example, in games 30 mounted on a wall, the ball 220 and pegs 210 would be scaled up such as having wider lanes. The pegs 210 are preferably on one and one-half to two-inch centers and each peg is preferably three-sixteenths an inch in diameter. Each row of pegs 210 is preferably staggered from the adjacent row above and below by one-half the center-to-center distance between pegs 210. These dimensions illustrate the present invention and are not meant to limit the teachings thereof. While the present invention uses one ball 220 per bonus, it is to be understood that more than one ball 220 could be used and that more than one ball 220 could be simultaneously or successively launched. Furthermore, the present invention is not limited to balls. Any suitable play piece such as, but not limited to, a disc or token could be utilized.

It is important to prevent outside influences from affecting the operation of the Pachinko bonus game 30 such as 1) possible tilting of the Pachinko game 30 to coax the ball 220 into desirable lanes 230 and 2) possible use of magnets to coax a steel or magnetic ball. Both of these concerns are minimized in the present invention by using conventional leveling sensors and a non-magnetic ball 220. The algorithms, methods and display techniques discussed herein also counter such outside influences. While the use of plastic is preferred, the teachings of the present invention are not limited to plastic and other non-magnetic materials may be used. Furthermore, the algorithms and methods contained herein would also apply to conventional steel balls. Hence, the teachings of the present invention are not to be limited to use of either plastic balls or leveling sensors.

3. Algorithms. Algorithms for assigning the bonus game 30 payoff values 260 to the lanes L1-L8 include, but are not limited to, the following three algorithms:

Algorithm No. 1

The slot machine 20 assigns a random payoff value 260 to the bonus game 30, either before or during play, that is independent of the outcome of the Pachinko action. After the ball 220 travels through a lane 230, the predetermined random payoff value 260 assigned by the slot machine (or any underlying game) is displayed in display 250. Under this algorithm, the value of bonus payoffs is not determined by the ball 220 play in the Pachinko game.

Algorithm No. 2

Bonus payoff values 260 are randomly assigned to each lane 230 as a function of time and based upon game play. The value 260 for the bonus game 30 is determined by the displayed lane value at the time the ball 220 passes through a lane 230. This algorithm can either be free running (i.e., continuously) or start when the Pachinko bonus game 30 is activated. If free running, the cycle time for displaying a set of bonus payoffs 260 in displays 250 is preferably less than the typical Pachinko bonus game cycle time. For example, if it takes an average five seconds to play the Pachinko bonus game 30, then the display time could be two seconds. In this example, every two seconds new payoffs 260 would be randomly displayed in displays 250. The display time cannot be too fast since it must be viewed by a player, nor can it be too slow, if free running, since a player could take advantage of high payout values. Under the teachings of the present invention, the display time, $T_D$, is preferably less than the game cycle time, $T_G$, or $T_D \leqq T_G$.

It is to be understood that the display in each lane could change at the same time; or the display in each lane could change at staggered times. For example, the first lane at time $T_0$, the second lane at time $T_0+T_S$, the third lane at time $T_0+2T_S$, etc.; where $T_S$ is a predetermined stagger time period. This creates a flickering effect which is aesthetically pleasing. In yet another embodiment, the time a value is displayed in a lane is constant (equal), but the frequency of selection is based upon the weight of the value. These variations for the display time are discussed in more detail in a later section.

Algorithm No. 3

Bonus payoff values 260 are assigned and displayed in displays 250 to each lane 230 randomly, via a weighted probability pay table, at any time after the bonus game 30 is activated and before the ball 220 travels through a lane 230. These bonus payoff values 260 remain fixed and the lane 230 selected by the ball 220 determines the ultimate payoff amount for the bonus game. Algorithm No. 3 is the preferred embodiment for determining bonus payoff values 260 in that it allows players to see what bonus payoffs are possible, and to root for the ball 220 to settle into lanes 230 with high potential payoffs. It also gives players reassurance in knowing that no "funny business" is taking place (i.e., after launch the values 260 are fixed and known to the player, and subsequently the ball 220—and the ball 220 alone—determines the bonus payoff 260 the player will receive).

The above three algorithms are preferred embodiments. Other algorithms could be equivalently used under the teachings of the present invention.

4. Bonus Payoff Values 260 Details Based on Algorithm No. 3. Assume the desired average bonus payoff value for the Pachinko bonus game 30 is D units. The term "units" is used to refer to any suitable bonus payoff form such as monetary value (dollars), numbers of coins (number of quarters), tickets, etc. The teachings of the present invention are not limited to the form of the bonus payoff. Two preferred methods are used to determine the payoff.

Method 1: This method assigns bonus payoff values 260 to each lane 230 such that the expected value per lane 230 remains at D units, while particular bonus payoff values fluctuate above and below D units. In this fashion, the average value per game still remains at D units, but players experience variety in game play. In Method 1, the average value per game remains equal to D units regardless of any bias which may exist or which may develop in the Pachinko bonus game 30 toward the lanes 230 and is accomplished in the following manner.

Let the number of lanes be $N_L$ and the number of payoffs for lane be $R_l$. The set of payoffs and their associated weights (i.e., probabilities) for lane is $P_{l,k}$ and $w_{l,k}$, where k is an index assuming values from 1 to $R_l$. Let the desired average value for the game be D. Then for each lane the expected value becomes:

$$EV_l = \Sigma_k(w_{l,k} \times P_{l,k}) = \text{a constant} \qquad \text{FORMULA 1}$$

where $EV_l$=Expected Value for lane $P_{l,k}$=Set of rewards for lane $w_{l,k}$=Weights per lane Summing over the game lanes, with unknown probabilities of occurrence $W_l$, yields the expected value, EV, per game:

$$EV=\Sigma_l(w_l \times EV_l)=EV_l \times \Sigma w_l=EV_l \quad \text{FORMULA 2}$$

Thus EV for the game is simply that of each lane, provided this is constant (i.e., equal for each lane). Furthermore, EV is independent of the weights $w_l$ of occurrence for each lane. Thus any bias developing through wear and tear which affects the $w_l$ has no bearing on EV. With no multiplier (M=1), the solution is EV=D. This is an important advantage of the present invention that the bonus payoff values 260 of the game are unaffected by physical wear and tear of the associated hardware. That is, even if the Pachinko bonus game 30 becomes biased toward one or more lanes 230, the bonus payoff value 260 of the game is unchanged. Randomness and fairness to the house and to the player is maintained. In the worst case of bias, the ball would fall through the same lane, game after game, yet the value, D, for the game is recovered.

Assume the Pachinko bonus game 30 has a value, per play, of EV=D=50 units, then the following is an example of a weighted matrix of random assignments for each lane L1-L8 of FIGS. 1 and 2:

TABLE I

| | Weights/Lane | | | | | | | | |
|---|---|---|---|---|---|---|---|---|---|
| Payoff | L1 | L2 | L3 | L4 | L5 | L6 | L7 | L8 | |
| 10 | 0.15 | 0 | 0 | 0.7 | 0 | 0 | 0 | 0 | |
| 20 | 0.1 | 0 | 0 | 0 | 0 | 0 | 0 | 0.1 | |
| 30 | 0.1 | 0 | 0.25 | 0.1 | 0.2 | 0.4 | 0 | 0.6 | |
| 40 | 0.1 | 0 | 0 | 0 | 0.2 | 0.2 | 0.5 | 0 | |
| 50 | 0.1 | 1 | 0.5 | 0 | 0.2 | 0 | 0 | 0 | |
| 60 | 0.1 | 0 | 0 | 0 | 0.2 | 0 | 0.5 | 0 | |
| 70 | 0.1 | 0 | 0.25 | 0 | 0.2 | 0.2 | 0 | 0 | |
| 80 | 0.1 | 0 | 0 | 0 | 0 | 0.2 | 0 | 0 | |
| 90 | 0.15 | 0 | 0 | 0 | 0 | 0 | 0 | 0 | |
| 100 | 0 | 0 | 0 | 0 | 0 | 0 | 0 | 0.3 | |
| 200 | 0 | 0 | 0 | 0.2 | 0 | 0 | 0 | 0 | |
| | 50 | 50 | 50 | 50 | 50 | 50 | 50 | 50 | EV |

For example, for lane L4, there is a 70% chance the payoff chosen is 10 units, a 10% chance it is 30 units, and a 20% chance it is 200 units. The expected value for lane 4 is therefore 0.7×10+0.1×30+0.2×200=50 units, as required. The average bonus payoff value for each lane 230 is 50 units. However, the weights and associated possible bonus payoffs for each lane can be very different from each other. Furthermore, not all payoffs need to be possible for each lane, and vice-versa.

Several examples illustrate the operation of Table I. In the first example, assume that the controller (as will be discussed subsequently) selects the following payoff values for lanes L1-L8 of FIG. 2: {90, 50, 70, 200, 70, 80, 60, 100} which is shown in FIG. 2. In this first example, the controller has selected the highest bonus payoff combination for each lane which is possible under this method. It is also possible, under this method and as a second example, that the lowest combination of values could be selected and displayed in lanes L1-L8: {10, 50, 30, 10, 30, 30, 40, 20}. The second example represents the lowest payoffs that can be selected for each lane. Of course, any random combination of payoffs 260 based upon the percentage weights per lane could be selected by the controller from the payoff values in Table I. It is noted that for lane L2 in Table I, the payoff value of 50 is always selected. Under the teachings of the present invention any set of payoffs are possible such that Formula 1 is satisfied.

Further, to add even more randomness, the lanes L1-L8 can be rotated from game to game (i.e., the weights for lane 1 may be applied to lane 2 in the next game, and so forth). The fixed value of 50 for lane L3 in Table I would be the value for lane L4 for the next game, for lane L5 etc. Or, the mapping from Table I for each successive game to actual lanes 230 may be done in a random fashion. The fixed value of 50 for lane L3 in Table I would be the value for a randomly selected lane such as lane L7 for the next game.

Note, too, that this algorithm does not require that each expected payoff, on a per-game basis, is always exactly D units. This volatility is a further advantage of this approach. For a third example, the lane payoff values are randomly chosen to be: {80, 50, 50, 200, 30, 40, 60, 30} for lanes L1 through L8, respectively. The probability of this occurring is 0.00012, and the expected value for the bonus game 30 is greater than 50 units. However, in the long run, the payoff will average D units.

Table I represents an illustration showing how bonus payoff values 260 are randomly selected from a weighted matrix from bonus game to bonus game. Many other values of combinations are possible which fall within the teachings of the present invention. D may be any suitable value, the number of lanes L are a design choice, whether the lanes rotate, and the actual payoff values can be tailored to the casino's requirements. A low value of D, such as D≦5, would generate little excitement in playing the Pachinko bonus game 30, while a high value of D, such as D≧100, would generate higher excitement. Also of consideration is how frequently the bonus symbol(s) 26 stop at the payline 22. The more frequent, then a lower D may be desirable. The lower the frequency, then a higher D may be desirable. As will be discussed later, the weighted pay tables are stored in suitable memory and a random number generator is used to select payoff values from the weighted pay tables for display 250 in each lane L1-L8.

Method 2: An alternate approach which yields the same expected value EV each game is to randomly select a set of bonus payoff values 260 whose average value is D, and then assign each element of this set randomly to a lane 230.

For example, consider the following set of lane payoffs L1-L8: {20, 20, 30, 40, 40, 50, 100, 100} with an average value D=50. Each of these payoff values 260 are randomly mapped to a lane in a one-to-one fashion, thus ensuring a game of value D. No equipment bias affects the expected value of the game, through the random assignment of values to lanes from game to game. In choosing different sets of lane payoffs, the volatility of playing the bonus game 30 may be increased or decreased.

A modified form of Methods 1 and 2 is to tie into the temporal approach of Algorithm 2 by randomly varying the lane value 260 as a function of time, with frequency governed such that the time-averaged value is D (e.g., by Table 1 above). This can be done by, e.g., fixing the time of a reward at $T_D$ and selecting based on weight w, or fixing the selection as the same for all and selecting the period proportionate to weight. Other manifestations are possible. Provided that the period (time between changing values) is shorter than the typical cycle time for a ball to drop through a lane, but long enough for a player to recognize the present lane value, the game should provide considerable excitement. This will be discussed later.

Under the teachings of the present invention, instead of credits, prizes or other types of awards may be provided.

5. Lane Multiplier(s) Algorithm. In addition to the algorithms described above, additional lanes are provided elsewhere on the playing field 200 in an alternate embodiment.

Such rows could be added above or below lanes L1-L8. Such rows are designated areas of the playing field 200 that change the payoff value. While rows are shown, specific areas could be utilized. Sensors 302 such as trip levers, photodiodes, etc. can sense when the ball passes through the designated area.

Figure 3:
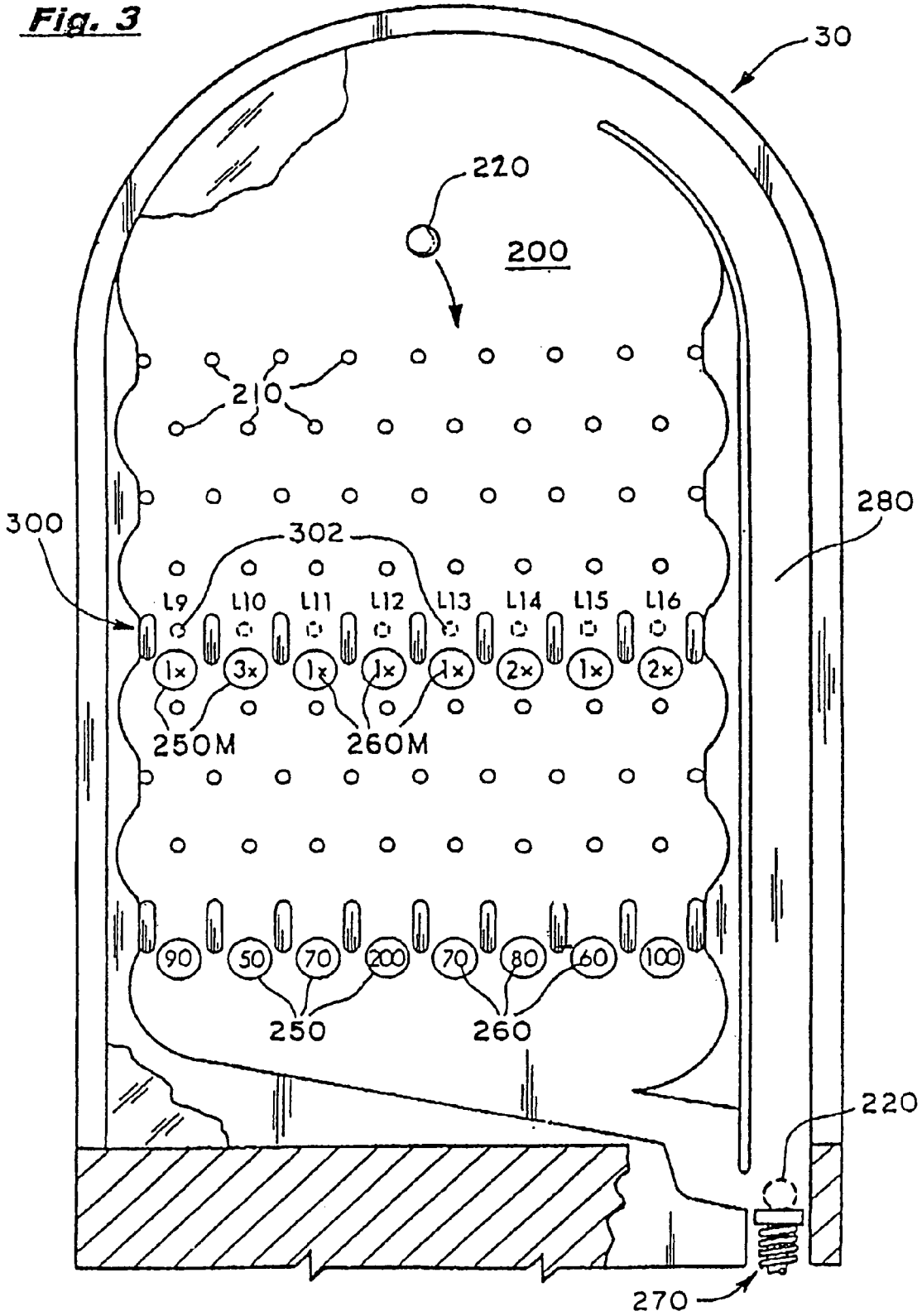
FIG. 3 is a front view of a second embodiment of the Pachinko bonus game of the present invention.

Consider the embodiment shown in FIG. 3 in which an additional row 300 of lanes L9-L16, positioned midway through the playing field 200, is utilized as a multiplier (i.e., M=1×, 2×, 3×, . . . ). The "×" symbol is used in the following as a "multiply sign." This row contains eight lanes also, each mapped in a random fashion to the set {1×, 1×, 1×, 1×, 1×, 2×, 2×, 3×} for lanes L9-L16. The multiplier value 260M is displayed in flush mounted displays 250M so that a player may easily view the multipliers assigned to that lane. Each new game results in randomly selected values for M for each lane. Then the average value of the multiplier M is 1.5×. This can be multiplied by the value of D for the lower lanes L1-L8 to determine the EV for the game as a whole. To whit, $$EV=M\times D \qquad \text{FORMULA 3}$$

Alternately, the values for the multipliers may be chosen in a fashion similar to that described in Method 1 above.

It is to be expressly understood in this embodiment, that any number of lanes in row 300 could be utilized to provide the multiplication. Furthermore, one or more of the lanes L9-L16 could be a "lose" lane (i.e., OX) so that when the ball 220 falls through that lane, the player loses; in which case when the ball 220 continues to fall and travel through on lanes L1-L8, the payoff value is not recorded. Indeed, passing through a lose lane, in one embodiment, would instantly cause the displays 250 to display "zero" and there could be a multimedia display informing the player and others of the lose. The location and number of the additional lanes L9-L16 is a design choice and they vary in number and can be placed anywhere in the playing field 200 above or below the pay lanes L1-L8. They do not have to be aligned in a row and can be dispersed on the field 200. Indeed, in some designs the ball 220 may enter a first multiplier lane (e.g., 2×) and then a second multiplier lane (e.g., 3×) before entering a payoff lane (e.g., $10—in which case the player receives 2×3×$10=$60). The number of lanes, the position of the lanes, and the number of rows are simply a design choice and do not depart from the teachings of the present invention; Under the teachings contained herein at least one multiplier area (i.e., one lane) could be used.

6. Lane Addition Algorithm. The row 300 in another embodiment could be additive, subtractive, or both. For example, lanes L9-L16 could be {1+, 1+, 1+, 1+, 1+, 2+, 2+, 3+} mapped in a random fashion where the average addition is A=1.5+. In another example, lanes L9-L16 could be {1+, 1+, 1−, 1−, 2+, 2−, 3+, 3−} mapped in a random fashion where the average addition is A=0. Again, only one, more than one, or a number of additive lanes equaling the number of payoff lanes could be used. Under the teachings contained herein, at least one addition area (i.e., one lane) could be used.

7. Double-or-Nothing Algorithm. In another embodiment, the player may replay the Pachinko bonus game as follows.

The player is given the option to double-or-nothing the bonus payoff just received such as by re-pushing a button 28 in FIG. 1. Should the player decide to risk the winnings from the prior Pachinko bonus game, the Pachinko lanes L1-L8 would then be displayed in meters 244 with either a "Double" or "Nothing" symbol. By randomly assigning four "Double" symbols and four "Nothing" symbols to the bottom eight lanes L1-L8 prior to re-propelling of the ball 220, the chances are 50/50 for success/failure each game. As before, this will be true despite any lane bias that may be present in the equipment.

Other variations in this embodiment include triple, quadruple, etc., or nothing. For example, lanes L1-L8 could have the set {0×, 0×, 0×, 0×, 0×, 2×, 2×, 4×} randomly mapped to it resulting in an average multiplier of M=1.

8. Payoff Displays. The displays 250 operate in several different techniques under the teachings of the present invention. In a first display technique, the displays 250 for all lanes simultaneously display the payoff values 260 for the entire game. In a second display technique, the displays 250 operate to flicker payoff values at different times during play of the game displayed, etc. In a third display technique, the time that a particular payoff value 260 is displayed in a lane 230 is proportional to the payoff weight so that a two hundred-dollar payoff would have a shorter display time and a ten-dollar payoff would have a faster display time.

Assume the following weighted matrix is used for a given lane 230 such as lane #1 in FIG. 2:

TABLE II

| Payoff Value | Weights |
|---|---|
| 20 | 0.5 |
| 30 | 0.3 |
| 70 | 0.2 |

The EV for the lane=20×0.5+30×0.3+70×0.2=33. This example will be used to illustrate the following three display techniques for a Pachinko game that lasts ten seconds (i.e., the average length of time it takes the ball 220 to settle in a lane 230 after it is propelled up).

The first display technique under the present invention is to associate the weights with the selection of the lane values (probability of selection proportional to weight) and keep the lane value fixed and displayed for a time equal to the entire Pachinko game. Thus, in the game, there is a 50% chance that the lane #1 value would be 20, a 30% chance it would be 30, and a 20% chance it would be 70. Once a weighted value is randomly selected, it would remain displayed 250 at its selected value for the duration of the game (i.e., ten seconds).

A second technique is to associate the weights with the selection of the lane values (probability of selection proportional to weight), thereafter keeping the lane value fixed and displayed for a predetermined period of time, $T_D$ such as two seconds. Assume that as the ball 220 is shot up, the lane value selection by the system of the present invention immediately begins. Then, for lane #1 value, there is a 50% chance that the lane value would be 20, a 30% chance it would be 30, and a 20% chance it would be 70. This value (whether 20, 30, or 70) would remain associated with lane #1 for two seconds. Thereafter, for the second lane #1 value selected, there is again a 50% chance that the lane value would be 20, a 30% chance it would be 30, and a 20% chance it would be 70. The second randomly chosen value again remains associated with lane #1 for two seconds, and so forth, until the ball ultimately settles in a lane. Table III shows the changing of the displayed value every two seconds for the ten second duration of the game:

TABLE III

| Selected Payoff Value | Probability of Selection | Display Time Period | Total Time Elapsed |
|---|---|---|---|
| 20 | 0.5 | 2 sec | 2 sec |
| 70 | 0.2 | 2 sec | 4 sec |
| 20 | 0.5 | 2 sec | 6 sec |
| 20 | 0.5 | 2 sec | 8 sec |
| 30 | 0.3 | 2 sec | 10 sec |

The display time period, $T_D$, can be the same for all lanes, or $T_D$ may be fixed but different for each lane (e.g., lane #1 may be varying with period two seconds while lane #6 may be varying with a period of one second). Furthermore, if $T_D$ is the same for all lanes, then they may all change simultaneously (i.e., lane selection begins at identical times for all lanes) or at staggered times (i.e., lane selection begins at offset times for different lanes). If $T_D$ is chosen to be greater than the game time, this defaults to the first technique discussed above in that the lane values are fixed for the duration of a game.

The first two techniques described above have the probability of lane value selection proportional to weight, and the display time period $T_D$ constant or equal.

A third technique is to associate the weights with the selection of the time $T_D$ that a lane value is displayed, with probability of selection constant or equal. This represents an opposite approach to that described above but retains the expected value EV. Then, for the first lane #1 value, there is a ⅓ chance that the lane value would be 20, a ⅓ chance it would be 30, and a ⅓ chance it would be 70. The time $T_D$ that the lane value is displayed in display 250 in lane #1 is proportional to the weight. Thus, taking the constant of proportionality to be, say, 4 seconds. If the lane value chosen is 20, it will remain displayed for $T_D$=0.5×4=2 seconds; if it is 30, it will remain so for $T_D$=0.3×4=1.2 seconds; if it is 70, it will remain so for $T_D$=0.2×4=0.8 seconds. After the display time interval $T_D$ (whatever its value), the process repeats: for the second lane #1 value, there is a ⅓ chance that the lane value would be 20 (with duration 2 seconds), a ⅓ chance it would be 30 (with duration 1.2 seconds), and a ⅓ chance it would be 70 (with duration 0.8 seconds), and so forth. Table IV shows the changing of the displayed value according to the third technique:

TABLE IV

| Selected Payoff Value | Probability of Selection | Display Time Period | Total Time Elapsed |
|---|---|---|---|
| 30 | 0.3333 | 1.2 sec | 1.2 sec |
| 20 | 0.3333 | 2 sec | 3.2 sec |
| 20 | 0.3333 | 2 sec | 5.2 sec |
| 70 | 0.3333 | 0.8 sec | 6 sec |
| 30 | 0.3333 | 1.2 sec | 7.2 sec |
| 70 | 0.3333 | 0.8 sec | 8 sec |
| 20 | 0.3333 | 2 sec | 10 sec |

The three techniques given above represent limiting cases. Solutions representing mixtures of these three techniques are also possible, in which a hybrid algorithm utilizes the weights both for value and time selection.

Finally, the weights assigned to payoffs need not sum to 1. If they don't sum to one, then they can be renormalized so that they do. In other words, they are mathematically equivalent. E.g., in the example above, the weights may be given as:

TABLE V

| Payoff Value | Weights |
|---|---|
| 20 | 1 |
| 30 | 0.6 |
| 70 | 0.4 |

The sum of these weights is 2, thus the renormalization factor is ½. In other words, multiplying each of the weights by ½ gives us an equivalent weighted matrix as before.

It is to be expressly understood that the example set forth in Table II above is only used to illustrate the three display techniques discussed above and the values chosen are not meant to limit the teachings contained herein. Any set of payoff values and any set of weights could be utilized so that displays 250 of payoff values 260 are observable by players playing the game of the present invention.

The display techniques discussed above can be incorporated individually (or as discussed mixed together) into the Pachinko bonus game or the Pachinko stand-alone game of the present invention. Finally, and as discussed elsewhere, the examples above are not to be limited to payoffs values as other payoffs could be given, or to a game time of ten seconds since any suitable game time could be used, or to a single ball 220 game as any number of balls 220 could be used (i.e., two or more balls launched or two or more separate launches), etc.

9. Stand-alone Pachinko Game. The algorithms, methods and display techniques of the present invention can also be employed if the Pachinko game is a stand-alone machine. In this case, however, some of the payoff values are net losers based on coin-in. To encourage variety in the lane payoff values, and to allow for a variety of house advantages, Method 1 coupled with either Algorithm No. 2 or Algorithm No. 3 is preferred in this case.

Consider a stand-alone five-coin Pachinko game with a desired 10% house advantage. Assume the multiplier value is fixed at M=1×. To obtain a payoff value of D=4.5, the following is an example:

TABLE VI

| | Weights | | | | | | | | |
|---|---|---|---|---|---|---|---|---|---|
| Payoff | L1 | L2 | L3 | L4 | L5 | L6 | L7 | L8 | |
| 0 | 0.2 | 0.2 | 0 | 0.855 | 0.955 | 0.55 | 0 | 0.5 | |
| 1 | 0.2 | 0 | 0 | 0 | 0 | 0 | 0 | 0 | |
| 2 | 0.1 | 0 | 0 | 0 | 0 | 0 | 0 | 0 | |
| 3 | 0.1 | 0 | 0 | 0 | 0 | 0 | 0.1 | 0 | |
| 4 | 0.2 | 0.5 | 0.5 | 0 | 0 | 0 | 0.3 | 0 | |
| 5 | 0.1 | 0.1 | 0.5 | 0 | 0 | 0 | 0.6 | 0.1 | |
| 10 | 0 | 0.2 | 0 | 0.1 | 0 | 0.45 | 0 | 0.4 | |
| 25 | 0.1 | 0 | 0 | 0.04 | 0 | 0 | 0 | 0 | |
| 100 | 0 | 0 | 0 | 0 | 0.045 | 0 | 0 | 0 | |
| 500 | 0 | 0 | 0 | 0.005 | 0 | 0 | 0 | 0 | |
| | 4.5 | 4.5 | 4.5 | 4.5 | 4.5 | 4.5 | 4.5 | 4.5 | EV |

As before, the value for each lane 230 is chosen randomly by a controller and displayed in displays 250, with weights according to Table II above. In so doing, any equipment bias in the stand-alone Pachinko game is nullified with respect to house advantage. In the example above, lane 5 will have a value of 100 coins 4.5% of the time. A 500-coin payoff in lane 4 will appear once every 200 games.

These payoffs are merely exemplary and can, of course, be modified to the particular design. Table II does demonstrate, however, the mechanism whereby large "jackpot"

values will periodically appear as possible payoffs and wherein the payoff values 260 in displays 250 are randomly changed from game to game.

These large jackpots can also arise from the use of multiple rows of lanes possibly including multipliers, additions, etc.

Figure 4:
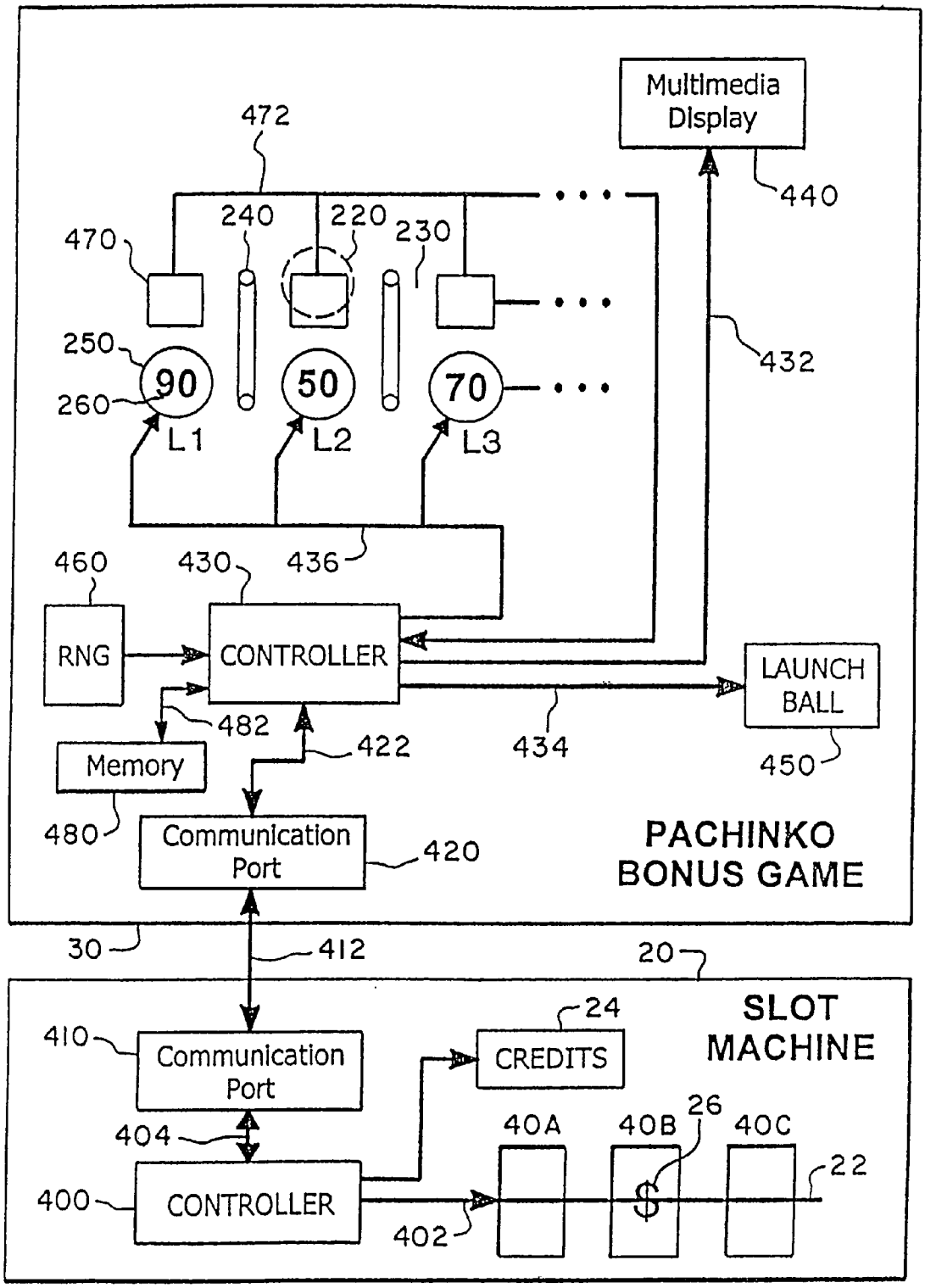
FIG. 4 is a block diagram of the interconnection showing the components of the Pachinko bonus game connected to the slot machine.

10. Bonus Game Hardware Configuration. FIG. 4 sets forth the details of the interconnection between the slot machine 20 and the Pachinko bonus game 30 of the present invention. The slot machine 20, as mentioned, may be any one of a large number of different slot machines from a wide variety of manufacturers. Modern slot machines 20 typically have reels 40A, 40B, and 40C which may be mechanical or electronic. However, any number of reels could be used. For example, the slot machine 20 may be played on a CRT screen. The design and operation of a slot machine 20 are well known. Under the teachings of the present invention, as shown in FIG. 1, a special symbol or symbols 26 is added to the control software for the slot machine controller 400 and to the reels 40A, 40B, and 40C. As discussed, the present invention is not limited to this one approach to "initiation" of the bonus game 30. The controller 400 is conventionally a microprocessor-based computer. When the special symbol or symbols 26 appears on the payline 22 of reels 40A, 40B, and 40C, as functionally represented by line 402, the controller 400 pauses or deactivates the slot machine game and delivers a communication over line 404 to a communication port 410 for delivery over lines 412 to a communication port 420 in Pachinko bonus game 30. This communication over lines 412 is an activation signal to activate the Pachinko bonus game 30. The Pachinko game controller 430 upon receipt of the activation signal initiates over lines 432 a multimedia display 440 on or near the Pachinko bonus game 30 which may be comprised of sounds (such as words and/or music), signage (such as a digital display announcing a bonus game), or graphics (such as a moving ball). The use of a multimedia display 440 is optional under the teachings of the present invention but is preferred and may encompass any of a wide variety of multimedia presentations.

The Pachinko game controller 430, in response to the activation signal received on lines 422 and the activation of button 28 by the player enables the launch ball mechanism 450 over line 434 to launch the ball 220 onto the field 200. Under alternate embodiments, the launch ball mechanism may be mechanically activated by a player such as by conventionally pulling back on a pull rod which is then released to propel the ball up chute 280 and into the playing field 200. Or, in other embodiments, a mechanical ball launcher 450 is used and if the player does not launch the ball within a predetermined time period, such as five seconds, the Pachinko game controller 430 automatically launches the ball. The Pachinko game controller 430, in response to the activation signal over lines 422, selects a set of payoff values 260 for delivery over lines 436 into the displays 250. Several approaches for determining what payoff values 260 are to be displayed have been discussed above. The Pachinko game controller 430 is suitably programmed and works with a random number generator 460 which may be a separate chip or software embedded in the Pachinko game controller 430 to randomly select payoff values from a table in memory 480 over lines 482 such as set forth in Table I and to display 250 the selected values 260 according to the display technique used. For example, under the first technique, the payoff values randomly selected are displayed for the game. When displays 250 start displaying values could be at any suitable time before the ball 220 travels through a lane 230 (e.g., upon launch, a fixed time after launch, etc.) For example, under the second technique (e.g., Table III, the displays 250 display new random payoff values every display time, $T_D$, such as every two seconds. The timing for this is conventionally obtained in controller 430. Finally, under the third technique (e.g., Table IV) the display $T_D$ varies in each lane based upon the weight of the payoff. All of these display times can be programmed into the controller 430 based upon the teachings contained herein.

After the ball 220 is propelled by the launch ball mechanism 450, the ball, after a period of time, travels through one lane 230. In FIG. 4, the ball 220 is shown passing through lane L2. Each lane 230 has a sensor 470 which senses the presence of the ball 220. For example, for a nylon ball 220, a suitable sensor is an infrared sensor or a diode switch flush mounted to field 200. The sensor 470 issues a signal on lines 472 back to the Pachinko game controller 430. In the preferred embodiment, each sensor 470 has an individual line 472 to the Pachinko game controller 430. Hence, the Pachinko game controller 430 knows which lane the ball 220 has fallen through and, therefore, the Pachinko game controller 430 knows which payoff value (in the example of FIG. 4, $50 or fifty coins) is to be awarded the player. The same type of hardware could be used to sense the presence of the ball 270 in a special change value area (such as area 300) with sensors 302 also connected to controller 430. The Pachinko game controller 430 then communicates with slot machine controller 400 through the communication ports 410 and 420 with the payout value 260 information so that the slot machine controller 400 can increment the credit meter 24 in the slot machine 20 with the payoff value 260 (for example $50).

It is to be expressly understood that a number of different designs could be implemented under the teachings of the present invention. For example, one skilled in the art could remove the random number generator 460 and the Pachinko game controller 430 as well as the communication ports 410 and 420, and have the connections 436, 472, 432, and 434 delivered directly into and under control of the slot machine controller 400.

The field 200 may have any number of recessed lights, lighted designs, and/or sound effects commonly found in Pachinko and pinball games which are not shown and which are controlled by Pachinko game controller 430.

Figure 5:
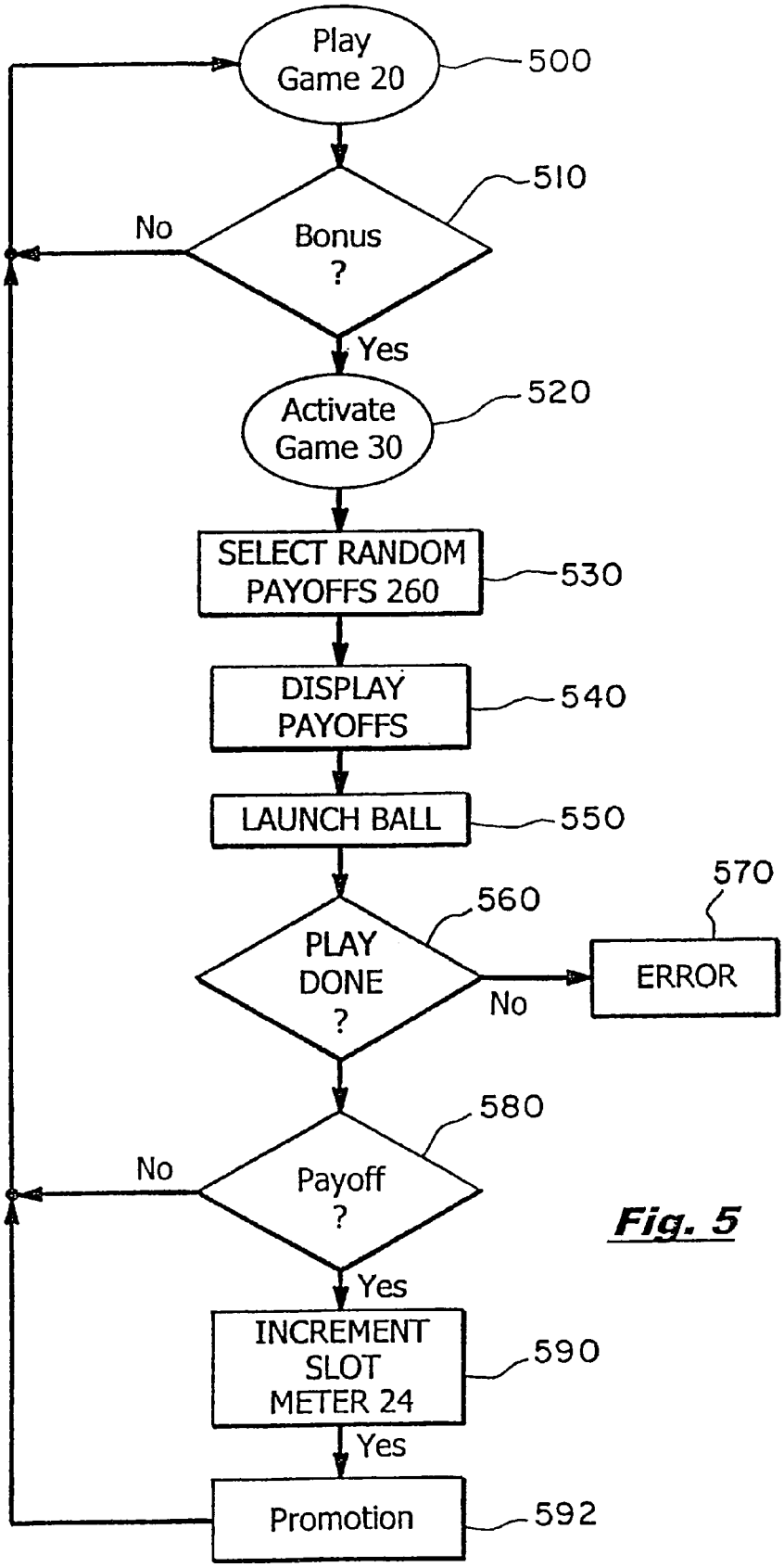
FIG. 5 is an operational flow chart for the Pachinko bonus game of the present invention.

11. Operation. In FIG. 5, operation of the present invention is set forth using the Pachinko game as a bonus game. In reference to FIG. 4, the slot machine 20 is conventionally played in stage 500. When a bonus symbol 26 appears on payline 22 in stage 510 (or other "initiation"), the controller 410 sends an activation signal to Pachinko game controller 430. Stage 520 is then entered. The Pachinko game controller 430, as discussed, selects random payoffs 260 in stage 530 based upon the random number generator 460 and the payoff table stored in memory 480 and in stage 540 displays them in displays 250. In stage 550, the bonus game is activated with the Pachinko game controller 430 activating launch ball mechanism 450. This corresponds to the first display technique.

It is to be expressly understood that the order of stages 530, 540, and 550 can vary based upon algorithm, the method, and the display technique being used as discussed above as well as other design considerations. The launch ball mechanism 450 is activated in stage 550 and play is done when the ball 220, as shown in FIG. 4, is sensed by one of the sensors 470. If too much time elapses, and the ball 220 is not sensed after launch, an error stage 570 may be entered.

When the ball 220 is sensed in a lane 230 in stage 560, then in stage 580, the Pachinko game controller 430 determines the value of the payoff assigned for the lane, delivers that information to controller 400 which then increments the credit meter 24 in stage 590. In stage 592, the Pachinko game controller 430 may cause a multimedia display 440 to occur based upon the win received by the player. After which, play is resumed at the slot machine 20 in stage 500 and the process repeats.

In summary, a method for playing a Pachinko game modified according to the teachings herein is disclosed. The method of the present invention utilizes a payoff table such as a weighted payoff table to randomly select a payoff value for each of the payoff lanes. There is no limitation on the number of payoff values that can be used. The selected random payoff values are displayed one at each of the plurality of payoff lanes before or after a playing piece is delivered onto the playing field. Delivery could be launching and propelling as fully discussed above where the ball is forcefully delivered onto the playing field. Delivery could also be inserting the ball through a specific opening and letting gravity cause the ball to fall as shown in U.S. Pat. No. 5,016,879. The playing piece traverses through a plurality of deflection devices until it travels through one of the payoff lanes. The payoff which is displayed at the payoff lane the playing piece travels through is issued. Under one method of the present invention, the weighted payoff matrix can have any number of possible values, each with an associated weight. Through use of a matrix payoff table, as fully discussed above, large "jackpot" payoffs periodically occur. This occurs because the expected values are constant over a number of games.

The selection and display of the random payoff values in each of the plurality of lanes, as discussed above, can occur according to a number of different embodiments under the teachings of the present invention. The display of payoff values can start upon the occurrence of a game event such as the start of the game, reception of a wager, launching of the ball, or any event during the game.

Figure 6:
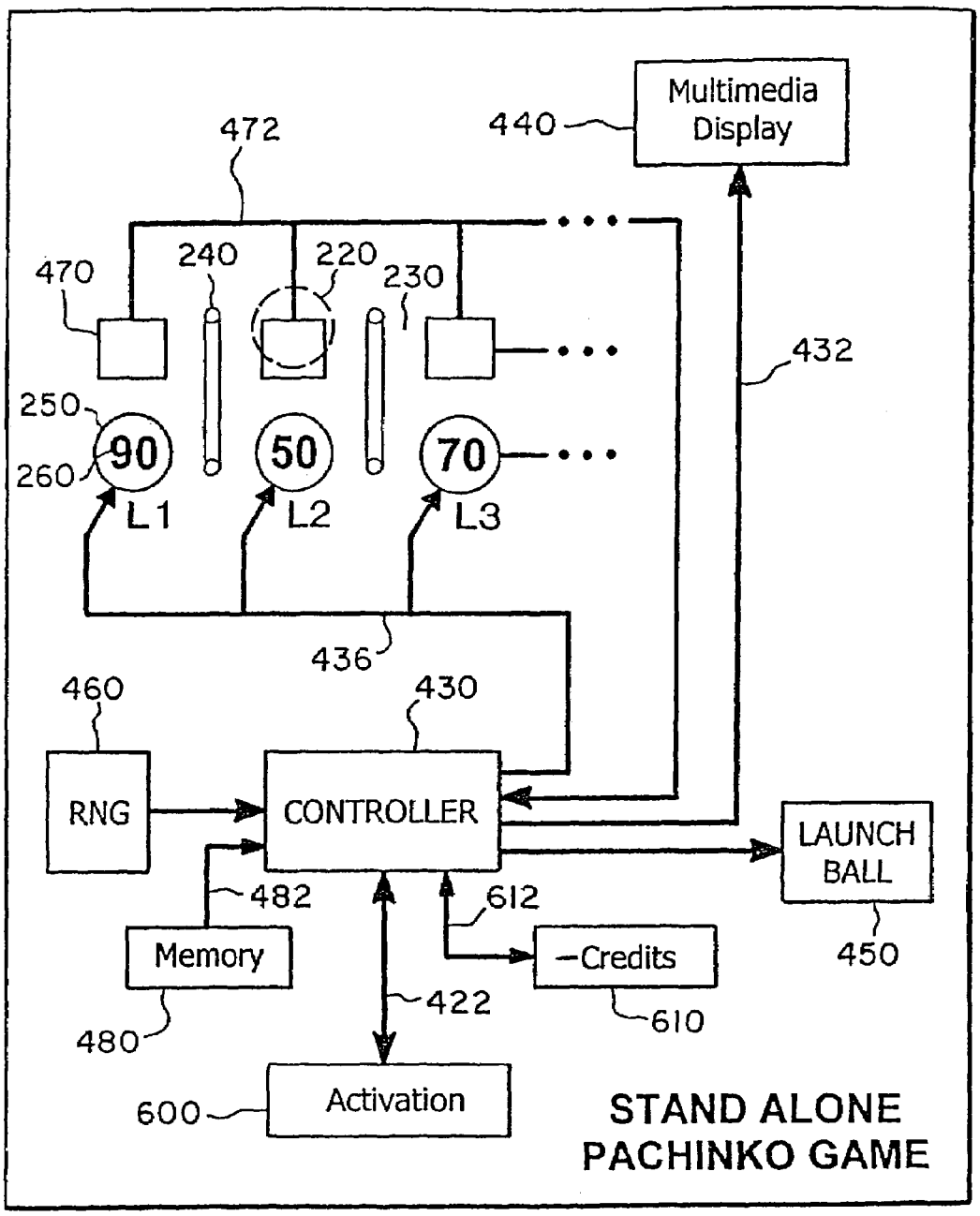
FIG. 6 is a block diagram of the stand-alone Pachinko game of the present invention.
Figure 7:
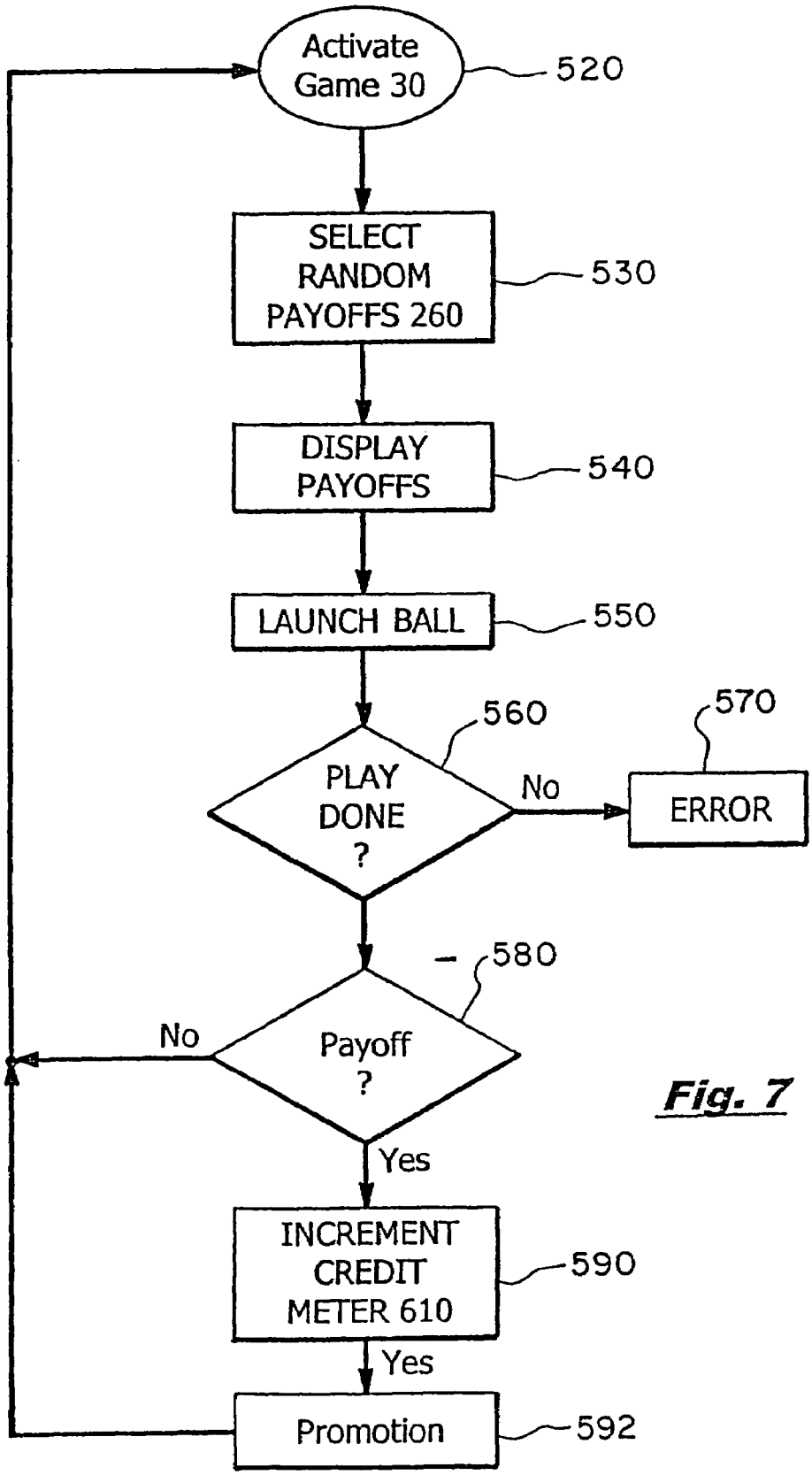
FIG. 7 is an operational flow chart for the stand-alone Pachinko game of the present invention.

12. Stand-alone Pachinko Game. In FIGS. 6 and 7, the details of the stand-alone Pachinko game 30 is shown. Where possible, like numbers are utilized which refer to earlier discussed structure and functions.

In FIG. 6, the hardware configuration for the stand-alone Pachinko game 30 is shown. This corresponds to the hardware configuration for the Pachinko bonus game shown in FIG. 6. However, an activation circuit 600 is shown which activates the controller 430 in the manner discussed above. In all other aspects, the hardware configuration for the stand-alone Pachinko game 30 of FIG. 6 corresponds to the discussion of FIG. 4 for the Pachinko bonus game. However, the activation circuit 600 constitutes any suitable activation conventionally used for a casino game such as receiving monetary value in the form of a wager (bill acceptor, coin in, etc.) and an activation signal from the player such as a start button, pulling of a handle, touching of an icon on a screen, etc. In addition, a credit meter 610 is provided in the stand-alone Pachinko game as shown by display 610 which directly communicates with the controller 430 over lines 612. In the event the player wins, the credits 610 are appropriately incremented. In the case a player loses, the credits 610 are appropriately decremented.

Likewise, in FIG. 7, the functional flow chart of the stand-alone Pachinko game 30 is set forth. This corresponds substantially to FIG. 5. Here when the payoff occurs in stage 580, the credit meter 610 of FIG. 6 is appropriately incremented or decremented.

13. Payoff Dispensing Mechanism. In yet another alternate approach to the teachings of the present invention, Pachinko game 30 of the present invention can utilize as a payoff dispensing mechanism. Formula 1 sets forth an overall payoff value of D as the expected value, EV.

It is well known in conventional game play for an underlying casino machine 20, that payoffs are commonly given. These payoffs are typically shown as printed charts actually on the machine. For example, in the case of the slot machine 20 and three double bars, the payoff printed on the chart may be twenty dollars. A player receiving a winning combination for the underlying casino gaming machine 20 is assured of receiving the printed payoff value. Under the teachings of the present invention, whenever a winning combination is obtained by a player at the underlying gaming machine 20, the Pachinko game 30 automatically is activated to allow the player the opportunity to receive more or less than the printed payoff value. In other words, the Pachinko bonus game of the present invention acts as a payoff-dispensing machine. From the casino operator's point of view, under Formula 1, the casino still pays the printed payout values. However, from the viewpoint of the player, a significant and additional level of excitement and further game play is present in watching the Pachinko game operate to dispense payoff which may be more or less than the stated printed payoffs. In some embodiments of this modification of the present invention, a player may have the option to take the printed payoff value or to play automatically for the higher or lower value.

14. Fixed Payoff Embodiment. The disclosed Pachinko bonus game and/or the stand-alone Pachinko game discussed above, in this embodiment, provides fixed payoff values 260 for lanes L1-L8 which could be printed at each lane or displayed in displays 250. Hence, the payoff values remain the same from game-to-game. Of course, this embodiment is subject to mechanical bias.

The above disclosure sets forth a number of embodiments of the present invention. Those skilled in this art will however appreciate that other arrangements or embodiments, not precisely set forth, could be practiced under the teachings of the present invention and that the scope of this invention should only be limited by the scope of the following claims.

We claim:

1. A method for operating a mechanical casino bonus game to provide a constant player expected value for play of the mechanical casino bonus game in the presence of mechanical bias, the mechanical casino bonus game having a game outcome selected mechanically from a number of game outcomes, play of the mechanical casino bonus game occurring in conjunction with play of an underlying casino game, the method for operating comprising:

commencing play of the mechanical casino bonus game when a bonus game condition occurs in play of the underlying casino game;

randomly assigning a bonus payoff from a set number of bonus payoffs for each game outcome in the number of game outcomes for the aforesaid play of the mechanical casino bonus game, the set number being greater than one;

mechanically selecting one of the set number of game outcomes during play of the mechanical casino bonus game;

awarding a player the random bonus payoff assigned to the mechanically selected one game outcome;

providing the constant player expected value for the mechanical casino bonus game over all play of the mechanical casino bonus game even in the presence of mechanical bias.

2. The method of claim 1 wherein the set number of bonus payoffs is greater in number than the number of game outcomes, the assigned bonus payoffs providing a different random combination of bonus payoff values ranging in value from a highest combination of bonus payoff values to a lowest combination of bonus payoff values for each play of the mechanical casino bonus game.

3. The method of claim 1 wherein the mechanical casino bonus game is a Pachinko game, wherein a game outcome is an exit lane, and wherein commencing play comprises:

delivering a freely moving mechanical object onto a mechanical playing field having a plurality of mechanical deflection devices.

4. The method of claim 3 wherein the mechanical object is a ball.

5. The method of claim 3 wherein the mechanical object is a disc.

6. The method of claim 3 wherein the mechanical object is a token.

7. The method of claim 1 wherein randomly assigning a bonus payoff comprises:

providing a matrix of the set number of bonus payoffs and a plurality of probability weights;

randomly assigning by probability weight the bonus payoff.

8. The method of claim 7 wherein the probability weight for at least one bonus payoff in the set number for at least one game outcome in the matrix is zero.

9. The method of claim 7 wherein at least one bonus payoff in the set number has a probability weight in only one game outcome.

10. The method of claim 7 wherein the probability weight for at least one payoff in the set number of payoffs is one hundred percent in one game outcome and zero percent for all other payoffs in the set number of payoffs for the aforesaid game outcome.

11. The method of claim 7 wherein the probability weight for each game outcome is different for each payoff in the set number of payoffs than the probability weights for the remaining game outcomes.

12. The method of claim 7 wherein the probability weights for each game outcome are rotated, with each new bonus game play, from game outcome to game outcome.

13. A method for operating a mechanical casino bonus game to provide a constant player expected value for play of the mechanical casino bonus game in the presence of mechanical bias, the mechanical casino bonus game having a game outcome selected mechanically from a number of game outcomes, play of the mechanical casino bonus game occurring in conjunction with play of an underlying casino game, the method for operating comprising:

commencing play of the mechanical casino bonus game when a bonus game condition occurs in play of the underlying casino game;

randomly assigning a bonus payoff from a set number of bonus payoffs for each game outcome in the number of game outcomes for play of the mechanical casino bonus game; the assigned bonus payoffs randomly providing a different player expected payoff value for each play of the mechanical casino bonus game, the set number being greater than one;

mechanically selecting one of the set number of game outcomes during play of the mechanical casino bonus game;

awarding a player the random bonus payoff assigned to the mechanically selected game outcome;

providing the constant player expected value for the mechanical casino bonus game over all play of the mechanical casino bonus game even in the presence of mechanical bias.

14. The method of claim 13 wherein the different player expected value is not the constant player expected value.

15. The method of claim 13 wherein the set number of bonus payoffs is greater in value than the number of game outcomes.

* * * * *